US007037241B2

(12) United States Patent
Kuo

(10) Patent No.: US 7,037,241 B2
(45) Date of Patent: May 2, 2006

(54) EXERCISE DEVICE

(75) Inventor: Parkson Kuo, Taipei (TW)

(73) Assignee: Via Technologies, Inc., Taipei (TW)

( * ) Notice: Subject to any disclaimer, the term of this patent is extended or adjusted under 35 U.S.C. 154(b) by 254 days.

(21) Appl. No.: 10/663,680

(22) Filed: Sep. 17, 2003

(65) Prior Publication Data

US 2004/0063549 A1 Apr. 1, 2004

(30) Foreign Application Priority Data

Sep. 18, 2002 (TW) ..... 91214747 U

(51) Int. Cl.
*A63B 22/06* (2006.01)

(52) U.S. Cl. ..... 482/51; 482/54; 482/57; 482/61

(58) Field of Classification Search ..... 482/1–9, 482/51, 54, 55, 57, 61, 900–902
See application file for complete search history.

(56) References Cited

U.S. PATENT DOCUMENTS 4,026,545 A * 5/1977 Schonenberger ..... 482/54
5,980,256 A * 11/1999 Carmein ..... 434/55
6,152,854 A * 11/2000 Carmein ..... 482/4

* cited by examiner

*Primary Examiner*—Glenn E. Richman
(74) *Attorney, Agent, or Firm*—Rabin & Berdo, PC

(57) ABSTRACT

An exercise device providing treadmill and stationary bicycle configurations. The exercise device has a running device with a tread belt, a bicycle device with a pair of pedals, and a transmission device detachably connecting the running device and the bicycle device. Further, a controlling device for controlling the running device and the bicycle device, a sensing device for detecting exercise information of the running device and the bicycle device, a computer module comprising a program of an interactive game for the running device and the bicycle device, and a processor performing the program, and a displaying device connected to the computer module for showing the interactive game thereon according to a plurality of parameters of the program are provided.

40 Claims, 11 Drawing Sheets

20

300

EXERCISE DEVICE

BACKGROUND OF THE INVENTION

1. Field of the Invention

The present invention relates to an exercise device, and in particular to an exercise device provided with a combo stationary bicycle and running machine to provide a wide variety of interactive exercise options.

2. Description of the Related Art

Exercise devices of various types are well known and popular. One widely used exercise device is a running machine, i.e. a treadmill 10, comprising a belt 13 driven by roller shafts 15*a* and 15*b*, as shown in FIG. 1. Settings such as speed are input from a panel 12 and a handrail 11 is held while running on the belt 13. The front and back roller shafts 15*a*, 15*b* either actively drive the belt 13 as the user 1 runs or walks thereon, or, in passive mode, freely rotate, driven by user tread activity producing friction on the belt 13.

Another widely used exercise device is a conventional stationary bicycle 20, comprising a seat 21, a plurality of pedals 23, a handrail 25 and a panel 27, as shown in FIG. 2. The user 1 sits on the seat 21 and holds the handrail 25 while cycling on the stationary bicycle 20, and the cycling speed and distance are shown on the panel 27 coupling to the pedals 23.

However, with the conventional devices, exercise is often repetitive and boring, especially when performed indoors. Further, both the conventional devices provide only a very limited range of exercise experience, and thus, little motivation or interest to the user.

SUMMARY OF THE INVENTION

Accordingly, an object of the present invention is to provide an exercise device, which includes both treadmill and stationary bicycle functions, providing walking, running, and cycling experiences to make exercise routines fresh and motivating.

Another object of the present invention is to provide an exercise device, which has a display or other simulation apparatus, offering the user a simulated environment for both mental and physical interactivity.

To achieve foregoing and other objects, the present invention is directed to an exercise device providing treadmill and stationary bicycle configurations, which includes a running device with a tread belt, a bicycle device with a wheel and a pair of pedals connected to the wheel, and a transmission device detachably connecting the tread belt and the wheel.

A preferred embodiment of the present invention has a running device with a tread belt, a bicycle device with a wheel and a pair of pedals connected to the wheel, a transmission device detachably connecting the tread belt and the wheel, a controlling device comprising a controller connected to the running device and the bicycle device for controlling the running device and the bicycle device and a control panel for enabling input of operational settings of the exercise device to the controller, a sensing device for detecting exercise information of the running device and the bicycle device, and sending a signal related to the exercise information, a computer module comprising a program of an interactive game for the running device and the bicycle device and a processor performing the program, and a displaying device connected to the computer module for showing the interactive game thereon according to a plurality of parameters of the program, in which the computer module receives the signal related to the exercise information from the sensing device to modify the parameters of the program in response to the exercise information.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
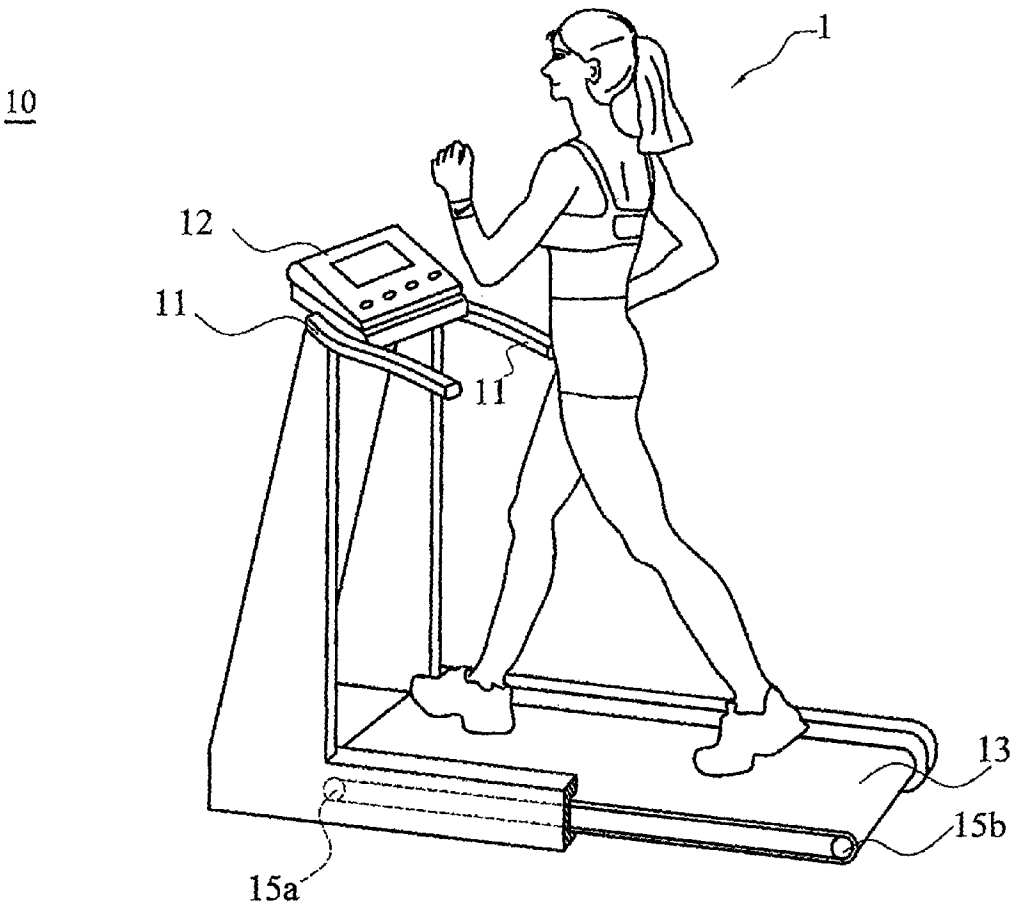
FIG. 1 ( PRIOR ART )
FIG. 1 is a schematic view of a conventional treadmill.
Figure 2:
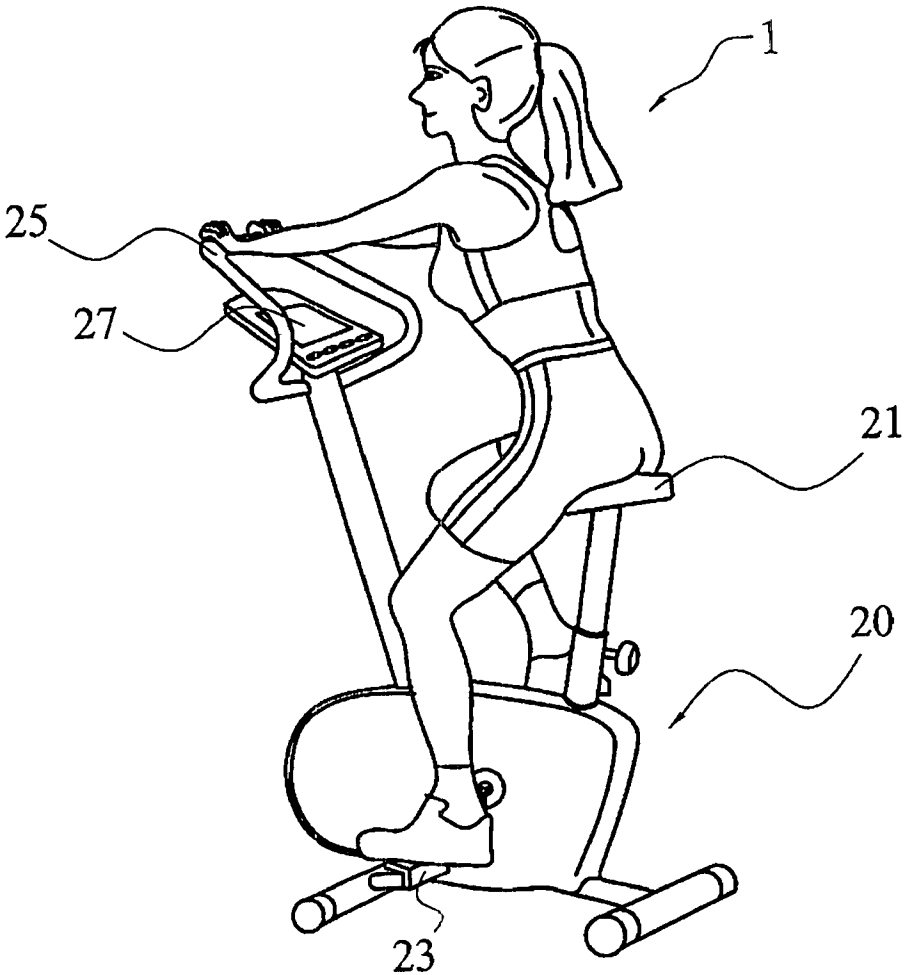
FIG. 2 ( PRIOR ART )
FIG. 2 is a schematic view of a conventional stationary bicycle.

FIGS. 3A to 3D illustrate a first embodiment of the exercise device 200 of the present invention. The exercise device 200 has a running device 220, a bicycle device 240, a controlling device 260, and a computer module 280.

Figure 3A:
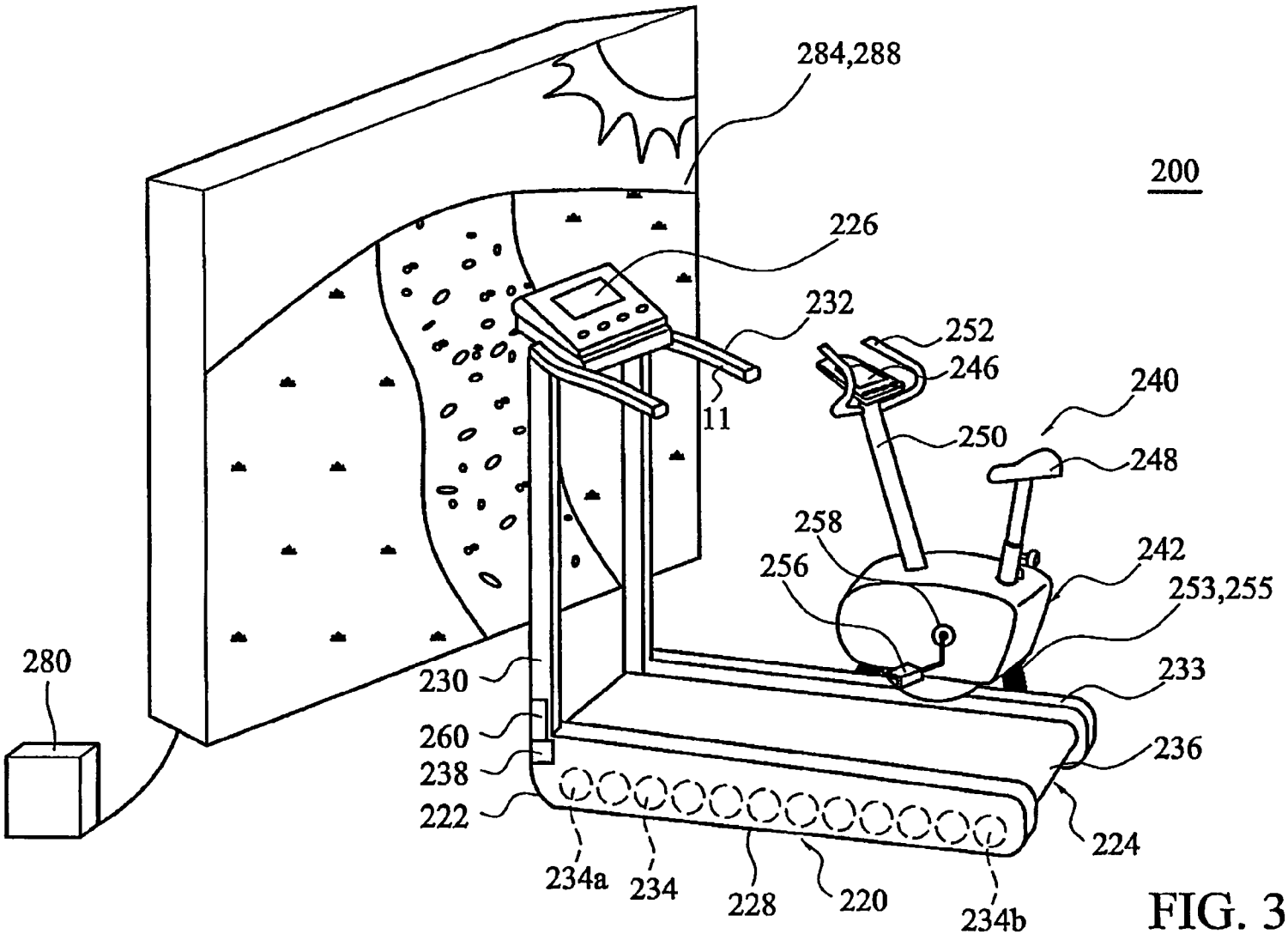
FIG. 3A is a schematic view of an exercise device 200 of a first embodiment of the present invention.

The running device 220, as shown in FIG. 3A, has an L-shaped frame 222, a treadmill 224, a control panel 226 and a motor 238. The frame 222 is formed with a base 228 with two side boards 233 and two pillars 230 respectively connected to the side boards 233 at the front of the exercise device, and a set of handrails 232 is provided on the top of the pillars 230 for holding. The treadmill 224 has a plurality of roller shafts 234 and a tread belt 236. The roller shafts 234 are rotatably provided between the side boards 233, and the tread belt 236 is disposed on the roller shafts 234. Thus, the roller shafts 234 rotatably support the tread belt 236 so that a user can run on the tread belt 236 smoothly.

The motor 238, which is connected to the roller shafts 234, provides power for the treadmill 224 so that the tread belt 236 is driven to rotate around the roller shafts 234.

It should be noted that, in FIG. 3A, the motor 238 is disposed on the bottom of the pillars 230 to connect to the front roller shaft 234*a*. However, the motor 238 can be connected to the rear roller shaft 234*b*, or any other roller shafts 234.

The control panel 226, having a processing unit therein, is disposed on the handrail 232, enabling input of operational settings such as speed and active or passive mode selection of the running device 220. In passive mode, the user 1 can run at any desired speed, controlling the speed of the treadmill 224. In active mode, a predetermined speed of the treadmill 224 is set and followed by the user 1.

The bicycle device 240, as shown in FIG. 3A, has a body 242, a cycling device 244 and a control panel 246. The body 242 is formed with a seat 248 and a brace 250 with a set of handrails 252 provided on the top of the brace 250 for holding. The cycling device 244 has a wheel 254 provided on the bottom of the body 242 and a pair of pedals 256 connected to the axle 258 of the wheel 254.

The control panel 246, having a processing unit therein, is disposed on the handrail 252, enabling input of operational settings of the bicycle device 240.

Figure 3B:
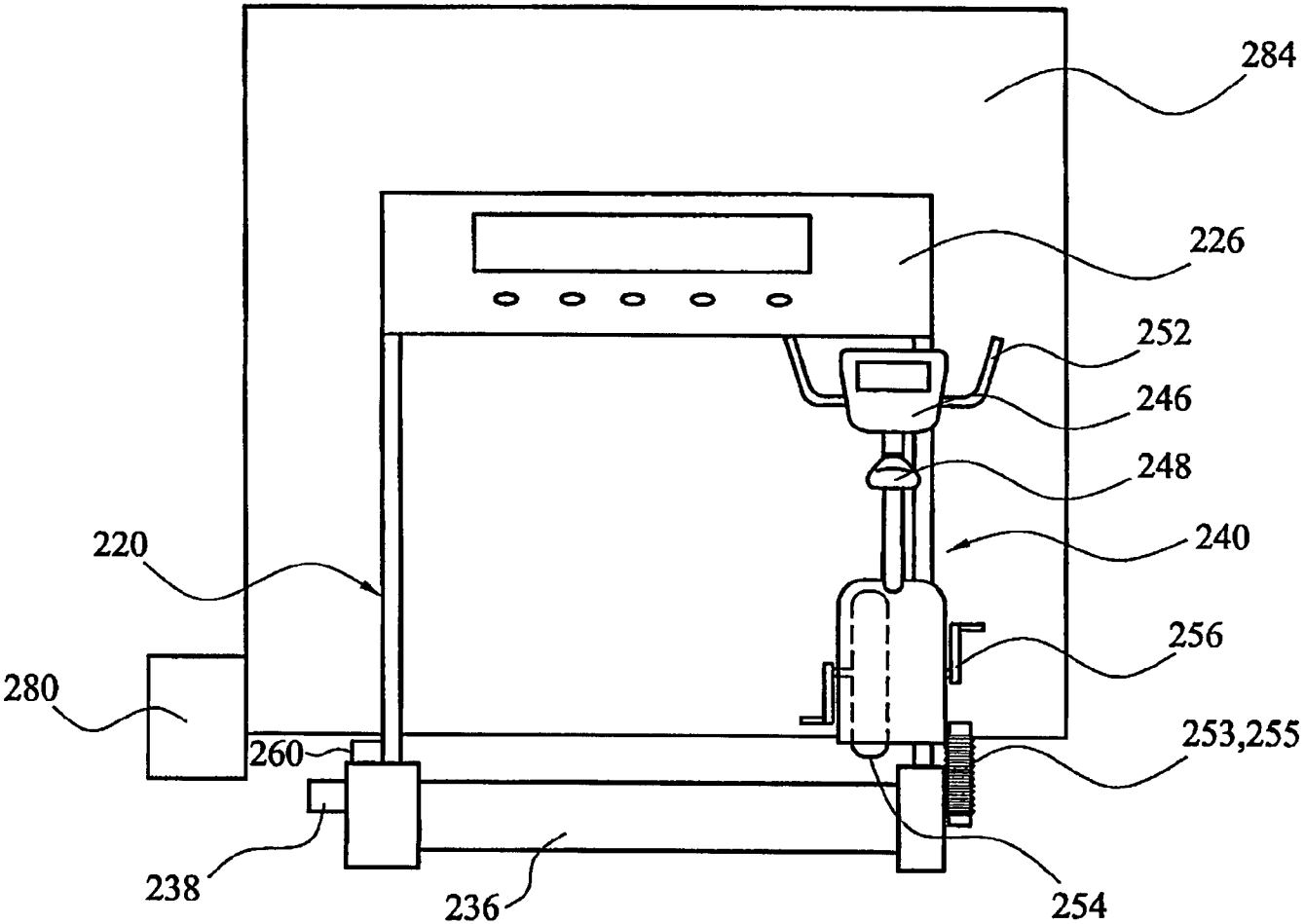
FIG. 3B is a rear view of the exercise device 200 of FIG. 3A.
Figure 3C:
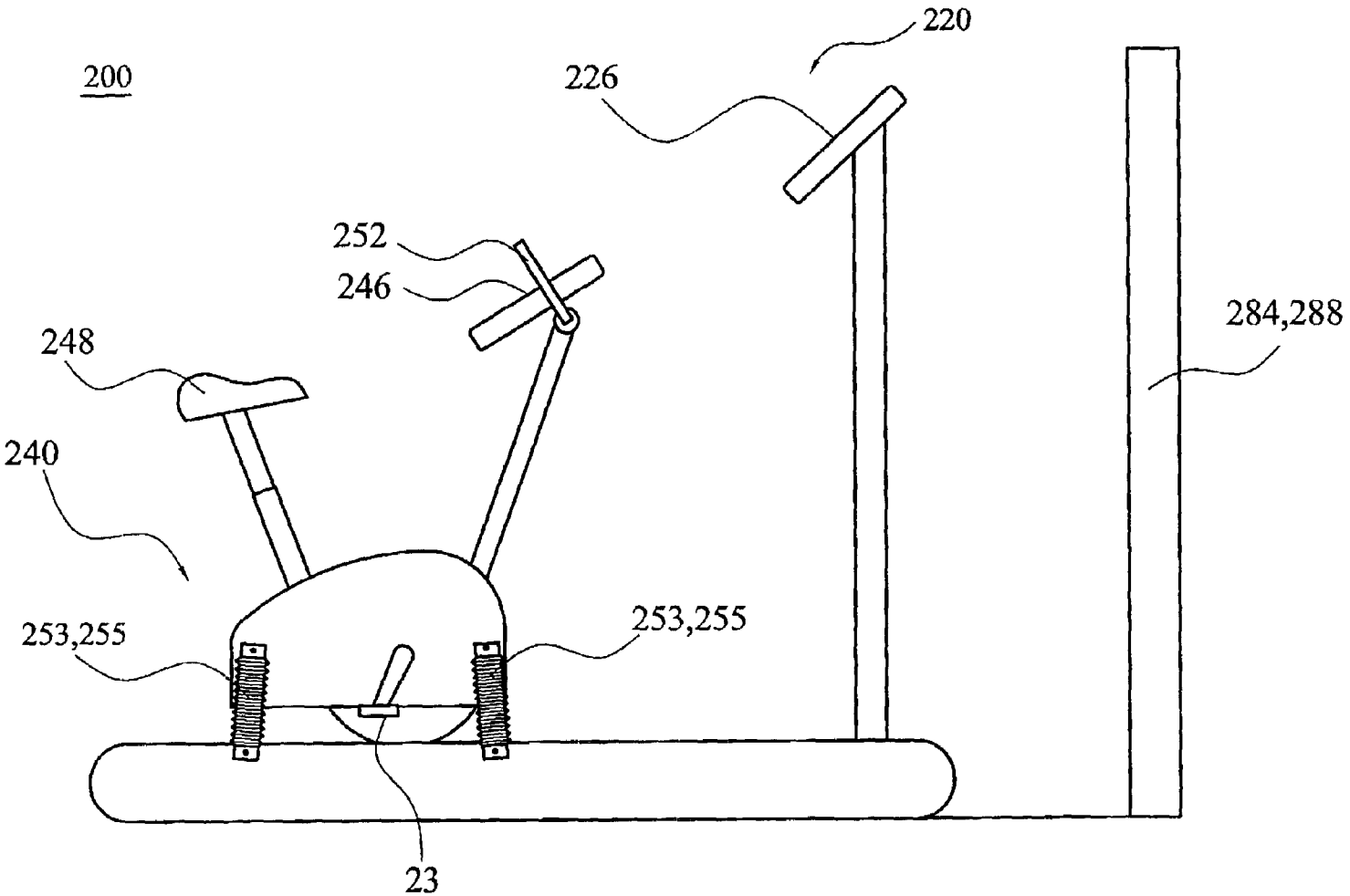
FIG. 3C is a side view of the exercise device 200 of FIG. 3A.
Figure 3D:
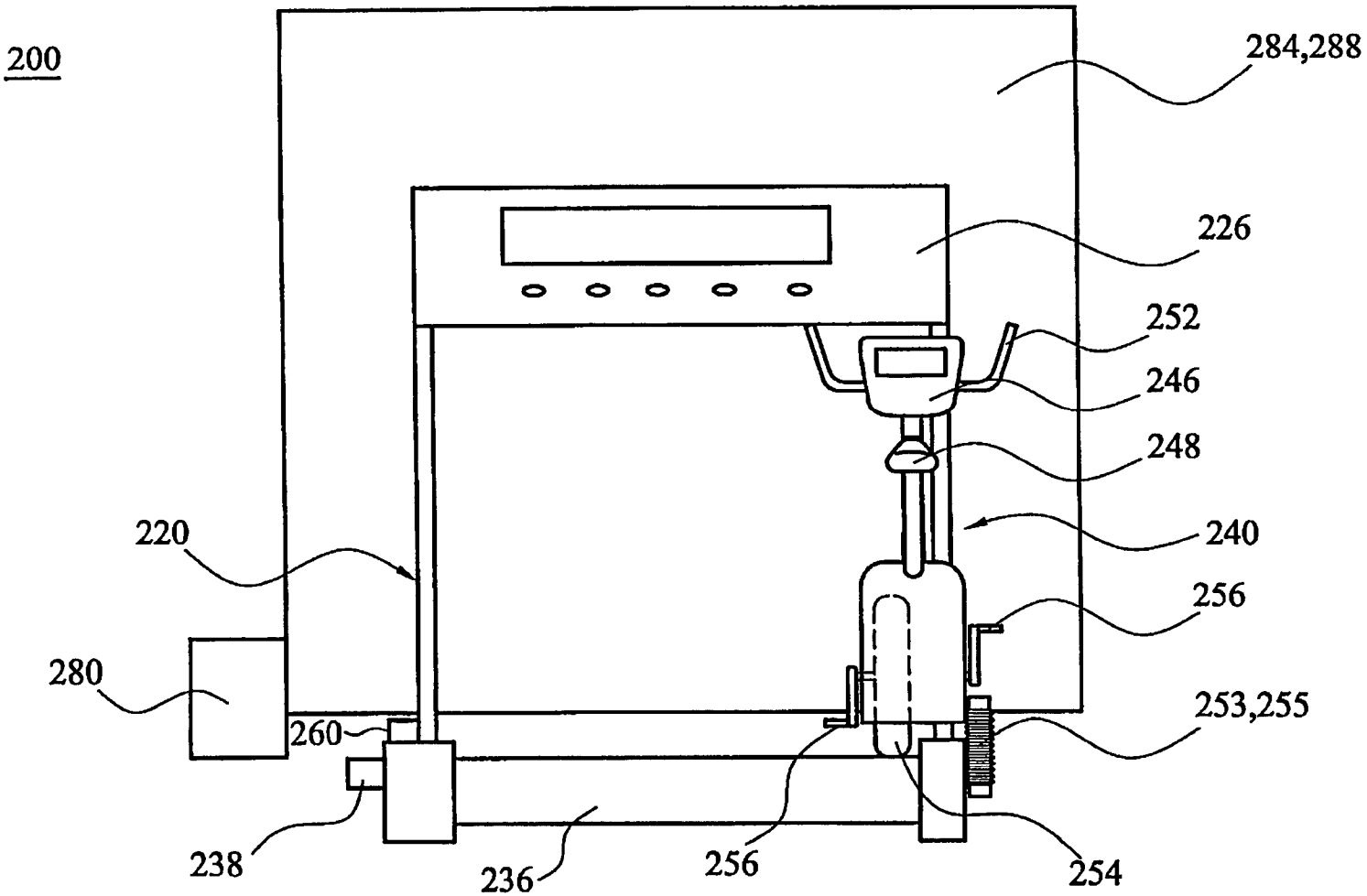
FIG. 3D is a rear view of the exercise device 200 of FIG. 3A, with the exercise device deployed in a stationary bicycle configuration.

A supporting device is provided under the body 242 as a transmission device to support the bicycle device 240. The supporting device has a spring device 253, which detachably connects the tread belt 236 and the wheel 254. When the bicycle device 240 is not in operation, as shown in FIG. 3B, the spring device 253 is clutched in a first state so that the wheel 254 is detached from the tread belt 236. On the other hand, when a user is using the bicycle device 240, as shown in FIG. 3D, the spring device 253 is clutched in a second state so that the wheel 254 is connected to the tread belt 236. Further, the supporting device has a hydraulic device 255, which can be controlled by the user from the control panel 246 to alternatively clutch in the first state and the second state.

Further, each of the control panel 226 of the running device 220 and the control panel 246 of the bicycle device 240 has a plurality of buttons for setting an interactive game for the running device 220 and the bicycle device 240. The interactive game is stored as a program in a computer module 280, which will be discussed later.

Figure 4A:
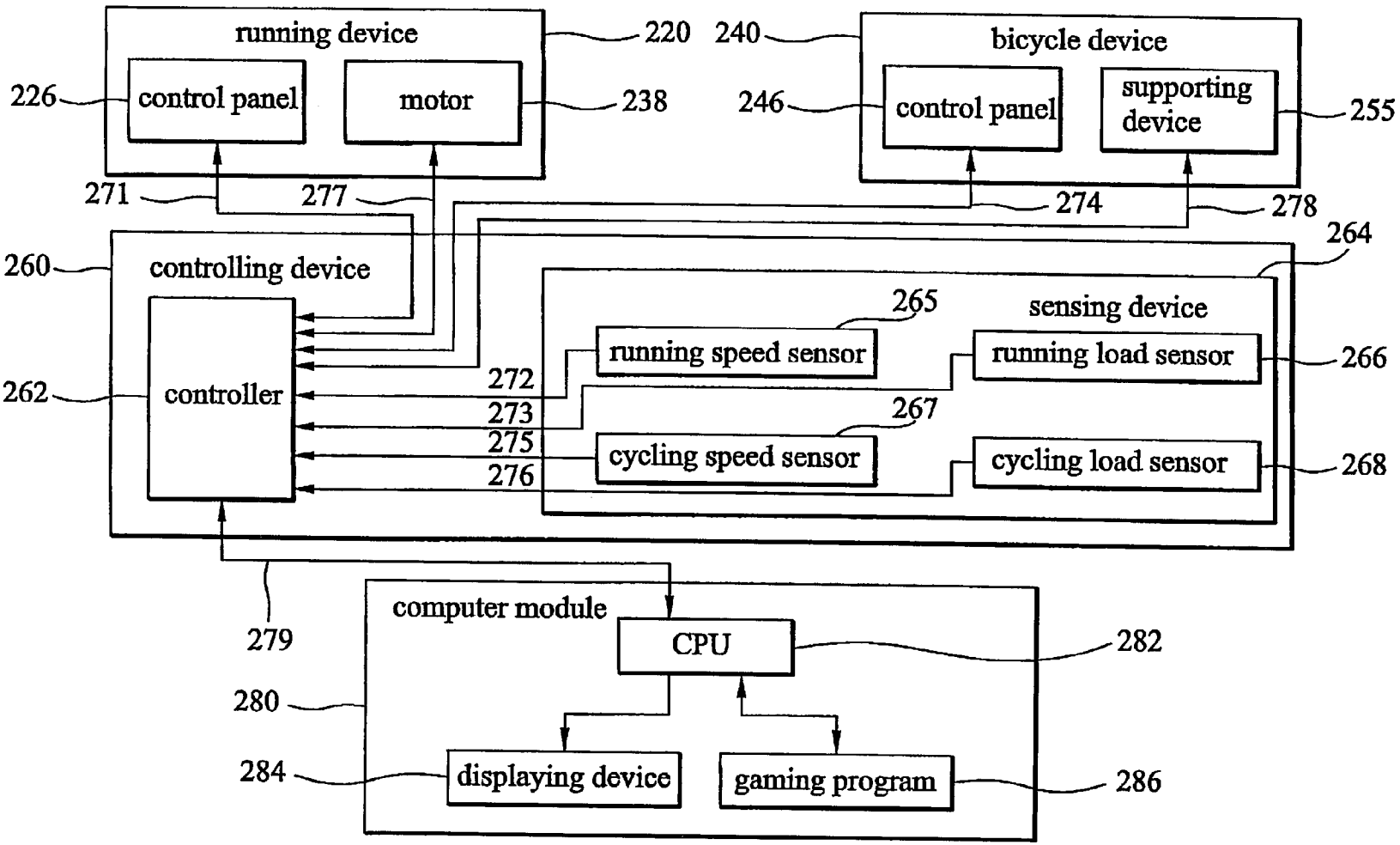
FIG. 4A is a flowchart showing an example of operation of the exercise device 200 according to the first embodiment of the present invention.

FIG. 4A is an architecture showing an example of operation of the exercise device 200 according to the first embodiment of the present invention. The exercise device 200 has a controlling device 260 and a sensing device 264. The controlling device 260 has a controller 262, which is connected to the running device 220 and the bicycle device 240 for controlling the running device 220 and the bicycle device 240. The sensing device 264, which has a plurality of sensors, is applied for detecting exercise information of the running device 220 and the bicycle device 240. The sensors include a running speed sensor 265 and a running load sensor 266 to detect running speed and load from the running device 220, and a cycling speed sensor 267 and a cycling load sensor 268 to detect cycling speed and load from the bicycle device 240. The controller 262 receives signals of the running/cycling speed and loads from the sensors 265, 266, 267, 268 via a plurality of signal lines 272, 273, 275 and 276, and transforms the signals to exercise information. Then, the controller 262 sends a signal related to the exercise information to the control panel 226 of the running device 220 via the signal line 271, or to the control panel 246 of the bicycle device 240 via the signal line 274, to show the exercise information to the user. The controller 262 controls the motor 238 to drive the tread belt 236 via the signal line 277. The controller 262 also controls the hydraulic device 255 (i.e. the supporting device) to alternatively clutch in the first state and the second state via the signal line 278. Further, the controller 262 is connected to the computer module 280 via a signal line 279.

Figure 4B:
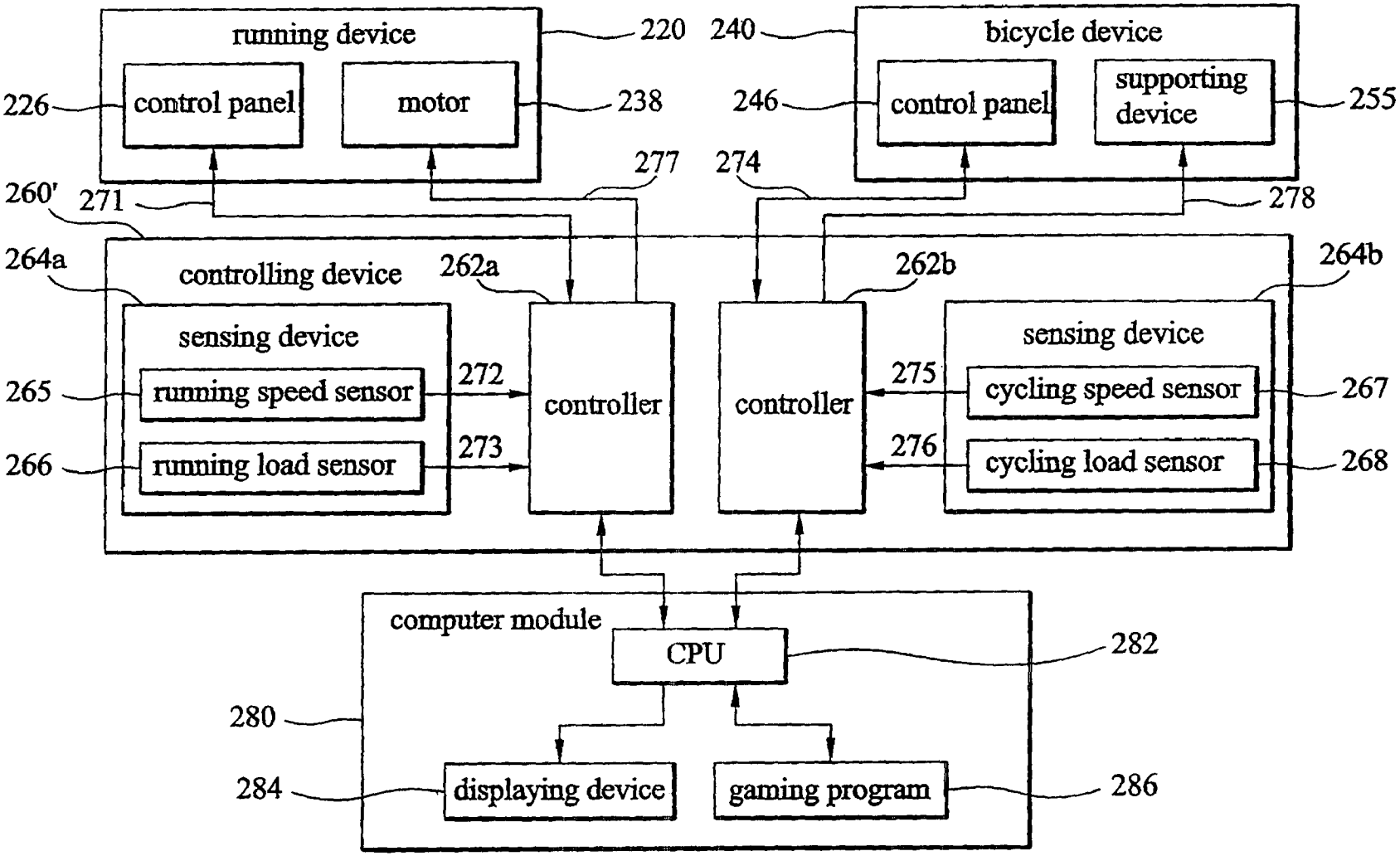
FIG. 4B is a flowchart showing a further example of operation of the exercise device 200 according to the first embodiment of the present invention.

It should be mentioned that any signal transmission device can be applied in the signal line configuration of the controlling device 260, which is not limited to the first embodiment in FIG. 4A. For example, a further configuration of operation of the exercise device 200 according to the first embodiment of the present invention is shown in FIG. 4B, in which two controllers 262*a* and 262*b* are applied to separately controls the running device 220 and the bicycle device 240.

The computer module 280 has a processor, i.e. a CPU 282, to perform a gaming program 286 stored therein. The program 286 provides an interactive game for the running device 220 and the bicycle device 240.

The computer module 280 receives the signal related to the exercise information from the controlling device 260 to modify the parameters of the program 286 in response to the exercise information.

Further, a displaying device 284 is connected to the computer module 280 for showing the interactive game thereon according to a plurality of parameters of the program 286. When the program 286 relates to a two-dimensional interactive game, the displaying device 284 can be a two-dimensional display, which includes a projector, a plasma display, an LCD, a large electronic display (LED), a computer display, a television display, or a television wall. On the other hand, when the program 286 relates to a three-dimensional interactive game, the displaying device 284 can be a three-dimensional display, i.e. a virtual-reality (VR) displaying system, which includes a VR helmet, a VR goggles, a VR projector or a three-dimensional projector.

Figure 5A:
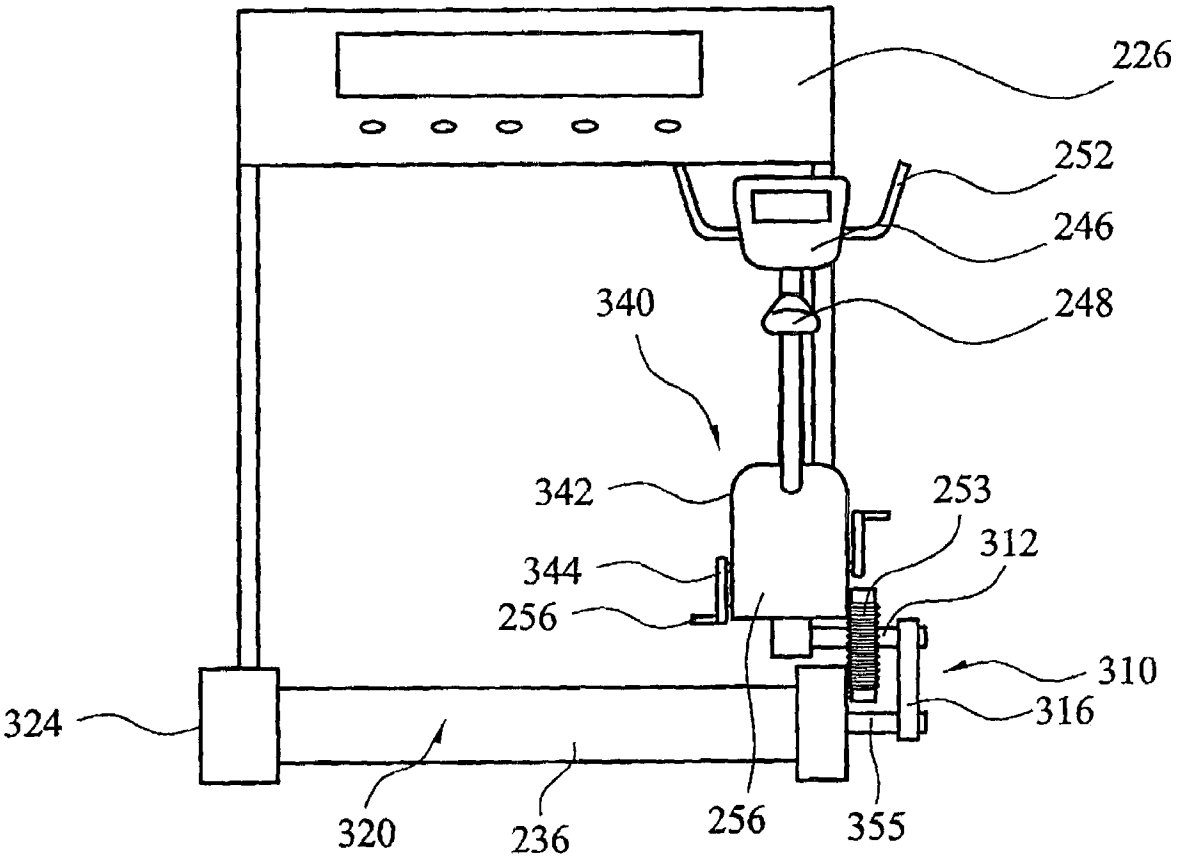
FIG. 5A is a schematic view of an exercise device 300 of a second embodiment of the present invention.
Figure 5B:
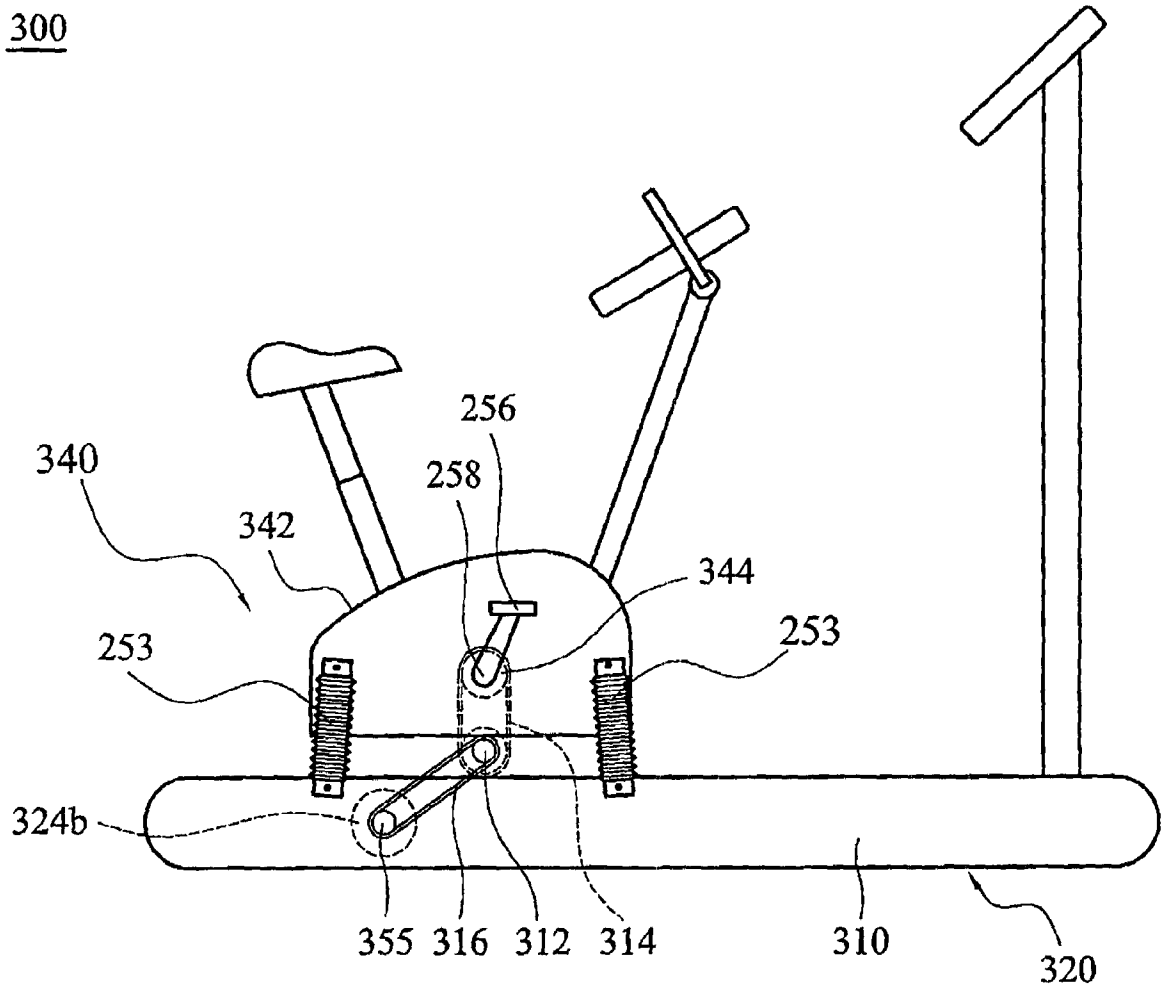
FIG. 5B is a side view of the exercise device 300 of FIG. 5A.

FIGS. 5A and 5B illustrate a second embodiment of the exercise device 300 of the present invention. The exercise device 300 has a running device 320 and a bicycle device 340. Further, a controlling device 260 and a computer module 280 are also provided in the exercise device 300.

A first linking belt 314 is provided between the axle 312 and the axle 258 of the pedals 256 to link the pedals 256 to the axle 312, and a second linking belt 316 is provided between the axle 312 and the rear roller shaft 324*b* to link the axle 312 and the rear roller shaft 324*b*.

Further, the transmission device can be provided in a variety of configurations, such as a clutch and a gear drive module.

Figure 6:
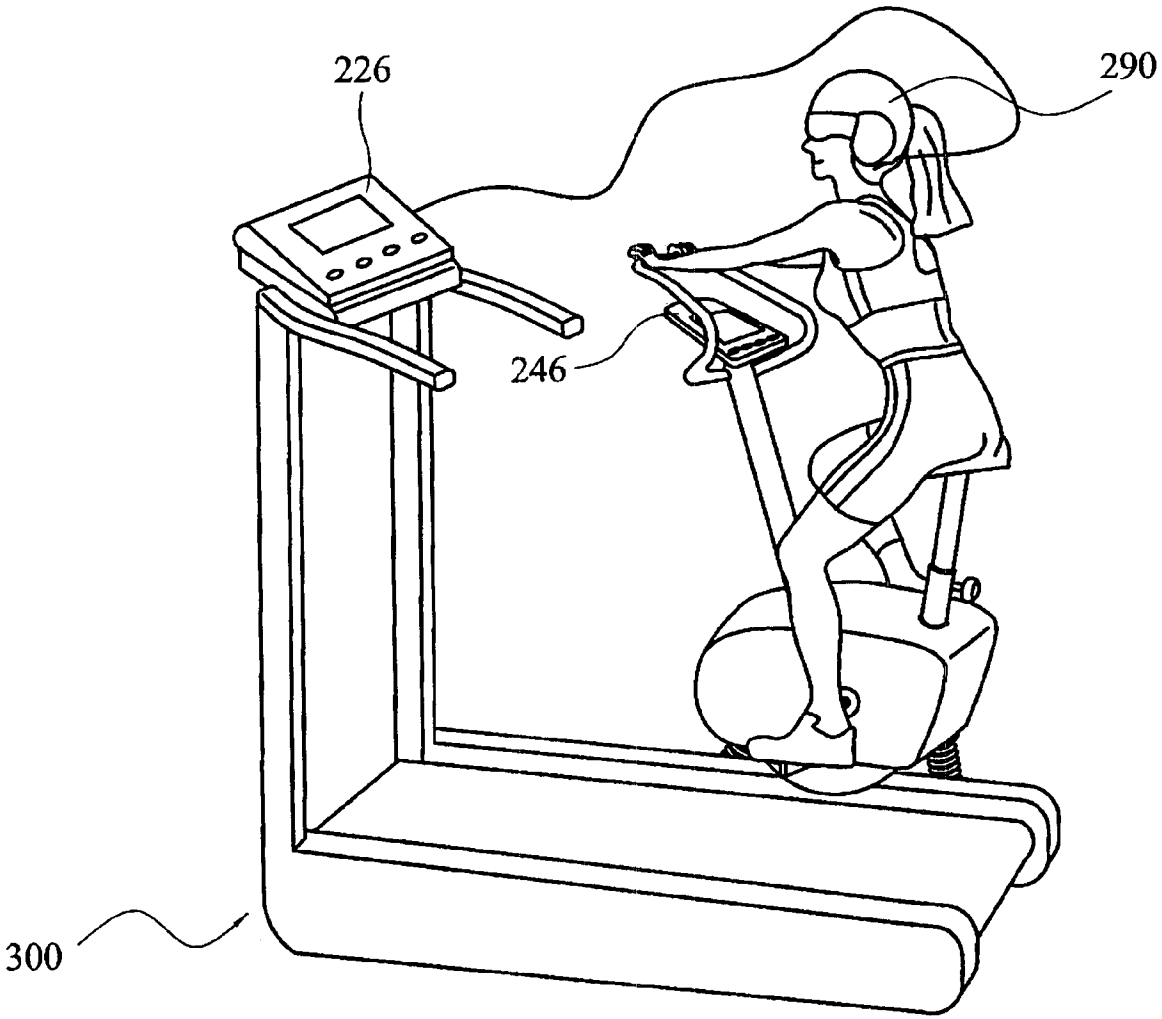
FIG. 6 is a schematic view showing the exercise device with personal display means of a third embodiment of the present invention.

FIG. 6 shows a third embodiment of the present invention, in which a VR helmet 290 is used as the displaying device of the exercise device. In FIG. 6, the VR helmet 290 is connected to the control panel 226 of the running device 220 via the controlling device 260 to display the interactive game to the user. On the other hand, the VR helmet 290 can be connected to the control panel 246 of the bicycle device 240, or to the controlling device 260, or to the computer module 280. It should be mentioned that wireless connection technique or any other connection system can be applied as the connection system of the exercise device of the present invention.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An exercise device providing treadmill and stationary bicycle configurations, comprising:

a running device with a tread belt;

a bicycle device with a pair of pedals and a wheel connected to the pedals; and a transmission device detachably connecting the running device and the bicycle device and comprising a supporting device supporting the bicycle device, wherein the supporting device is alternatively clutched in a first state during which the wheel is detached from the tread belt, and a second state in which the wheel is caused to directly abut against the tread belt and drives the tread belt by friction therebetween.

2. The exercise device as claimed in claim 1, wherein the supporting device comprises a hydraulic device.

3. The exercise device as claimed in claim 1, wherein the transmission device comprises a clutch, at least one of a belt pulley module and a gear drive module.

4. The exercise device as claimed in claim 1, further comprising a controlling device connected to the running device and bicycle device for controlling the running device and bicycle device.

5. The exercise device as claimed in claim 4, wherein the controlling device is further connected to the transmission device for controlling the tread belt and wheel.

6. The exercise device as claimed in claim 4, wherein the controlling device comprises a control panel for enabling input of operational settings of the exercise device.

7. The exercise device as claimed in claim 4, wherein the running device comprises a motor controlled by the controlling device.

8. The exercise device as claimed in claim 1, further comprising a processor performing a program of an interactive game for the running device and bicycle device.

9. The exercise device as claimed in claim 8, further comprising a controlling device connected to the processor, running device and bicycle device for controlling the running device and bicycle device.

10. The exercise device as claimed in claim 9, wherein the controlling device is further connected to the transmission device for controlling the tread belt and wheel.

11. The exercise device as claimed in claim 9, wherein the controlling device comprises a control panel for enabling input of operational settings of the exercise device.

12. The exercise device as claimed in claim 8, wherein the running device comprises a motor controlled by the controlling device.

13. The exercise device as claimed in claim 8, wherein the processor is further connected to the transmission device for controlling the tread belt and wheel.

14. The exercise device as claimed in claim 8, further comprising a displaying device connected to the processor for showing the interactive game thereon according to a plurality of parameters of the program.

15. The exercise device as claimed in claim 14, wherein the displaying device is a two-dimensional display.

16. The exercise device as claimed in claim 15, wherein the two-dimensional display comprises a projector, a plasma display, an LCD, a large electronic display (LED), a computer display, a television display, or a television wall.

17. The exercise device as claimed in claim 14, wherein the displaying device is a three-dimensional display.

18. The exercise device as claimed in claim 17, wherein the three-dimensional display comprises a virtual-reality (VR) displaying system.

19. The exercise device as claimed in claim 18, wherein the VR displaying system comprises a VR helmet, a VR goggles, a VR projector or a three-dimensional projector.

20. An exercise device providing treadmill and stationary bicycle configurations, comprising:

a running device with a tread belt;

a bicycle device with a pair of pedals and a wheel connected to the pedals;

a transmission device detachably connecting the running device and bicycle device and comprising a supporting device supporting the bicycle device;

a sensing device for detecting exercise information of the running device and bicycle device, and sending a signal related to the exercise information;

a computer module comprising a program of an interactive game for the running device and bicycle device and a processor performing the program; and a displaying device connected to the computer module for showing the interactive game thereon according to a plurality of parameters of the program, wherein the computer module receives the signal related to the exercise information from the sensing device to modify the parameters of the program in response to the exercise information, the supporting device is alternatively clutched in a first state during which the wheel is detached from the tread belt, and a second state in which the wheel is caused to directly abut against the tread belt and drives the tread belt by friction therebetween.

21. The exercise device as claimed in claim 20, further comprising a controlling device connected to the running device and bicycle device for controlling the running device and bicycle device.

22. The exercise device as claimed in claim 21, wherein the controlling device is further connected to the transmission device for controlling the tread belt and wheel.

23. The exercise device as claimed in claim 21, wherein controlling device comprises a control panel for enabling input of operational settings of the exercise device.

24. The exercise device as claimed in claim 20, wherein the supporting device comprises a spring device and a hydraulic device.

25. The exercise device as claimed in claim 20, wherein the transmission device comprises a clutch, at least one of a belt pulley module and a gear drive module.

26. The exercise device as claimed in claim 20, wherein the running device comprises a motor controlled by the controlling device.

27. The exercise device as claimed in claim 20, wherein the displaying device is a two-dimensional display.

28. The exercise device as claimed in claim 27, wherein the two-dimensional display comprises a projector, a plasma display, an LCD, a large electronic display (LED), a computer display, a television display, or a television wall.

29. The exercise device as claimed in claim 20, wherein the displaying device is a three-dimensional display.

30. The exercise device as claimed in claim 29, wherein the three-dimensional display comprises a virtual-reality (VR) displaying system.

31. The exercise device as claimed in claim 30, wherein the VR displaying system comprises a VR helmet, a VR goggles, a VR projector or a three-dimensional projector.

32. An exercise device providing treadmill and stationary bicycle configurations, comprising:

a running device with a tread belt;

a bicycle device with a pair of pedals and a wheel connected to the pedals;

a transmission device detachably connecting the running device and bicycle device and comprising a supporting device supporting the bicycle device;

a controlling device comprising a controller connected to the running device and bicycle device for controlling the running device and bicycle device, and a control panel for enabling input of operational settings of the exercise device to the controller;

a sensing device for detecting exercise information of the running device and bicycle device, and sending a signal related to the exercise information;

a computer module comprising a program of an interactive game for the running device and bicycle device, and a processor performing the program; and a displaying device connected to the computer module for showing the interactive game thereon according to a plurality of parameters of the program, wherein the computer module receives the signal related to the exercise information from the sensing device to modify the parameters of the program in response to the exercise information, the supporting device is alternatively clutched in a first state during which the wheel is detached from the tread belt, and a second state in which the wheel is caused to directly abut against the tread belt and drives the tread belt by friction therebetween.

33. The exercise device as claimed in claim 32, wherein the running device comprises a plurality of roller shafts for rotatably supporting the tread belt.

34. The exercise device as claimed in claim 33, wherein the running device comprises a motor for driving the tread belt.

35. The exercise device as claimed in claim 32, wherein the supporting device comprises a hydraulic device.

36. The exercise device as claimed in claim 32, wherein the displaying device is a two-dimensional display.

37. The exercise device as claimed in claim 36, wherein the two-dimensional display comprises a projector, a plasma display, an LCD, a large electronic display (LED), a computer display, a television display, or a television wall.

38. The exercise device as claimed in claim 32, wherein the displaying device is a three-dimensional display.

39. The exercise device as claimed in claim 38, wherein the three-dimensional display comprises a virtual-reality (VR) displaying system.

40. The exercise device as claimed in claim 39, wherein the VR displaying system comprises a VR helmet, a VR goggles, a VR projector or a three-dimensional projector.

* * * * *